US008061363B2

(12) United States Patent
Park

(10) Patent No.: US 8,061,363 B2
(45) **Date of Patent: *Nov. 22, 2011**

(54) METHOD AND PRODUCT FOR ATTAINING A FRENCH MANICURE USING A DRY NAIL POLISH APPLIQUE

(75) Inventor: Fa Young Park, Leonia, NJ (US)

(73) Assignee: Park Global Holdings, LLC, Leonia, NJ (US)

( * ) Notice: Subject to any disclaimer, the term of this patent is extended or adjusted under 35 U.S.C. 154(b) by 596 days.

This patent is subject to a terminal disclaimer.

(21) Appl. No.: 12/138,701

(22) Filed: Jun. 13, 2008

(65) Prior Publication Data

US 2008/0276951 A1 Nov. 13, 2008

Related U.S. Application Data

(63) Continuation-in-part of application No. 11/866,678, filed on Oct. 3, 2007, which is a continuation-in-part of application No. 11/543,481, filed on Oct. 5, 2006, which is a continuation-in-part of application No. 11/126,862, filed on May 11, 2005.

(60) Provisional application No. 60/570,713, filed on May 12, 2004.

(51) Int. Cl.
*A45D 29/00* (2006.01)

(52) U.S. Cl. ..... 132/73

(58) Field of Classification Search ..... 132/73, 132/285; 428/40

See application file for complete search history.

(56) References Cited

U.S. PATENT DOCUMENTS

| | | | | | |
|---|---|---|---|---|---|
| 2,162,155 | A | * | 6/1939 | Calvin | 132/73 |
| 2,688,331 | A | * | 9/1954 | Bogoslowsky | 132/73 |
| 2,746,460 | A | * | 5/1956 | Jellinek | 132/73 |
| 2,816,555 | A | * | 12/1957 | Klump | 132/73 |
| 3,023,887 | A | * | 3/1962 | Cohen | 132/73 |
| 3,993,084 | A | * | 11/1976 | Cullen | 132/73 |
| 4,903,840 | A | * | 2/1990 | So | 206/581 |
| 4,947,876 | A | * | 8/1990 | Larsen | 132/73 |
| 5,415,903 | A | * | 5/1995 | Hoffman et al. | 428/15 |
| 5,525,389 | A | * | 6/1996 | Hoffmann et al. | 428/41.5 |
| D459,547 | S | * | 6/2002 | Wada et al. | D28/56 |
| 2004/0079381 | A1 | * | 4/2004 | Han | 132/73 |

* cited by examiner

*Primary Examiner* — Robyn Doan
(74) *Attorney, Agent, or Firm* — Levisohn Berger, LLP

(57) ABSTRACT

A dry nail tip appliqué system for applying nail enamel to a nail tip. The nail tip appliqué comprises two distinct sections, a first section for coating the entire surface of a finger nail and a second section for applying dry nail polish to a nail tip. The two sections occupy distinct areas of an appliqué and each contains a handling tab. The nail polish material of the two sections are not contiguous with each other. This allows for a convenient and neat removal of the sections and for the application of the same.

6 Claims, 9 Drawing Sheets

METHOD AND PRODUCT FOR ATTAINING A FRENCH MANICURE USING A DRY NAIL POLISH APPLIQUE

RELATED APPLICATIONS

The current application is a Continuation-In-Part of pending U.S. patent application Ser. No. 11/866,678 filed on Oct. 3, 2007, which is a Continuation-In-Part of pending U.S. patent application Ser. No. 11/543,481 filed Oct. 5, 2006, which is itself a Continuation-In-Part of U.S. patent application Ser. No. 11/126,862, filed on May 11, 2005, which claims domestic priority from U.S. Provisional Patent Application No. 60/570,713, filed on May 12, 2004. The contents of all of the above-mentioned patent applications are incorporated by reference herein.

FIELD OF THE INVENTION

The current invention relates generally to the field of nail polish, more specifically, to a novel method and apparatus for attaining a French-style manicure using an instant dry film nail polish application.

BACKGROUND OF THE INVENTION

The use of an instant fingernail coating product whereby nail polish is applied to a fingernail by adhesively securing to it a dry form of nail polish has become a preferred mode of attaining a manicure by many users. Such dry nail polish products are disclosed in U.S. Pat. Nos. 4,903,840 and 5,415,903 each of which is incorporated by reference herein.

The nail coating product, or instant nail polish referenced above, confers numerous advantages over conventional, prior art nail polish applied with a brush in a liquid form. The application of instant nail polish is faster, easier and cleaner than conventional nail polish and does not suffer from the numerous encumbrances associated with wet nail polish such as drying time and the concern of smearing or smudging.

However, the previous dry nail coating products are not well adapted to applying a French-style manicure, wherein the tips of nails are coated with an enamel of a color that is different from the rest of the nail. Specifically, U.S. Pat. No. 4,903,840 discloses a dry nail coating application that is pre-printed with a design or a different color tip portion. Attaining a French-manicure with the pre-printed configuration is difficult, requires precision and is prone to imperfection.

U.S. patent application Ser. No. 11/543,481 discloses a novel nail appliqué in which a single nail appliqué is divisible into two separate sections—one of which is used for coating the entirety of a nail and a second one for coating only the nail's tip. A partial perforation between the two sections allows for the separation of each thereof. However, because the perforation is only a partial one, the two sections are joined together and remain as such even after removing the appliqué from its backing. Thus, in order to separate them, a user must firmly grasp each of the adjoining sections with her fingers and then pull them apart. This poses a risk that a nail appliqué may become damaged in the process and possibly be deemed unusable. Moreover, once the appliqué is removed, both sections must be used immediately. In addition, because there is only one handling tab, which is used to remove both portions, it is not intuitive to a user—especially an inexperienced one—that there are two separate portions to the appliqué—each with an independent function.

SUMMARY OF THE INVENTION

These drawbacks and disadvantages are addressed by the present invention, which is directed to an improved self-adhesive, French-style dry nail coating appliqué. The inventive appliqué comprises two separate portions—one for coating a fingernail (hereinafter "nail section") and another for coating a nail tip (hereinafter "nail-tip section")—each having their own handling tab. The two portions are not joined to one another, and as such, one portion may be removed without affecting the other. This allows for the easy and neat removal of an appliqué without the need to separate it from an adjoining portion. Furthermore, because the two portions can be removed individually, both sections do not need to be utilized immediately. For example, the nail portion may be left undisturbed while a user removes and applies the French tip portion. Moreover, because each portion has its own handling tab, a user will intuitively realize that each segment of the appliqué is serves a separate purpose.

Numerous advantages are realized with the inventive nail tip appliqué. The application of a French manicure using liquid nail polish entails applying a first coating of polish over the entire surface of a nail and waiting for the first coat to dry before applying a second coat of nail polish in a fine, neat strip across the tip of the nail. This process is time consuming, requires dexterity and is expensive when done at a nail salon. The nail tip appliqués described herein mitigates these problems with an easy tip coating applicator that requires minimal drying time, is pre-cut to conform to the shape of a nail tip and is easy to apply. The nail tip appliqué could be used on nails coated with ordinary liquid nail polish or with the dry nail coating products referenced herein.

DETAILED DESCRIPTION OF THE INVENTION

Figure 1:
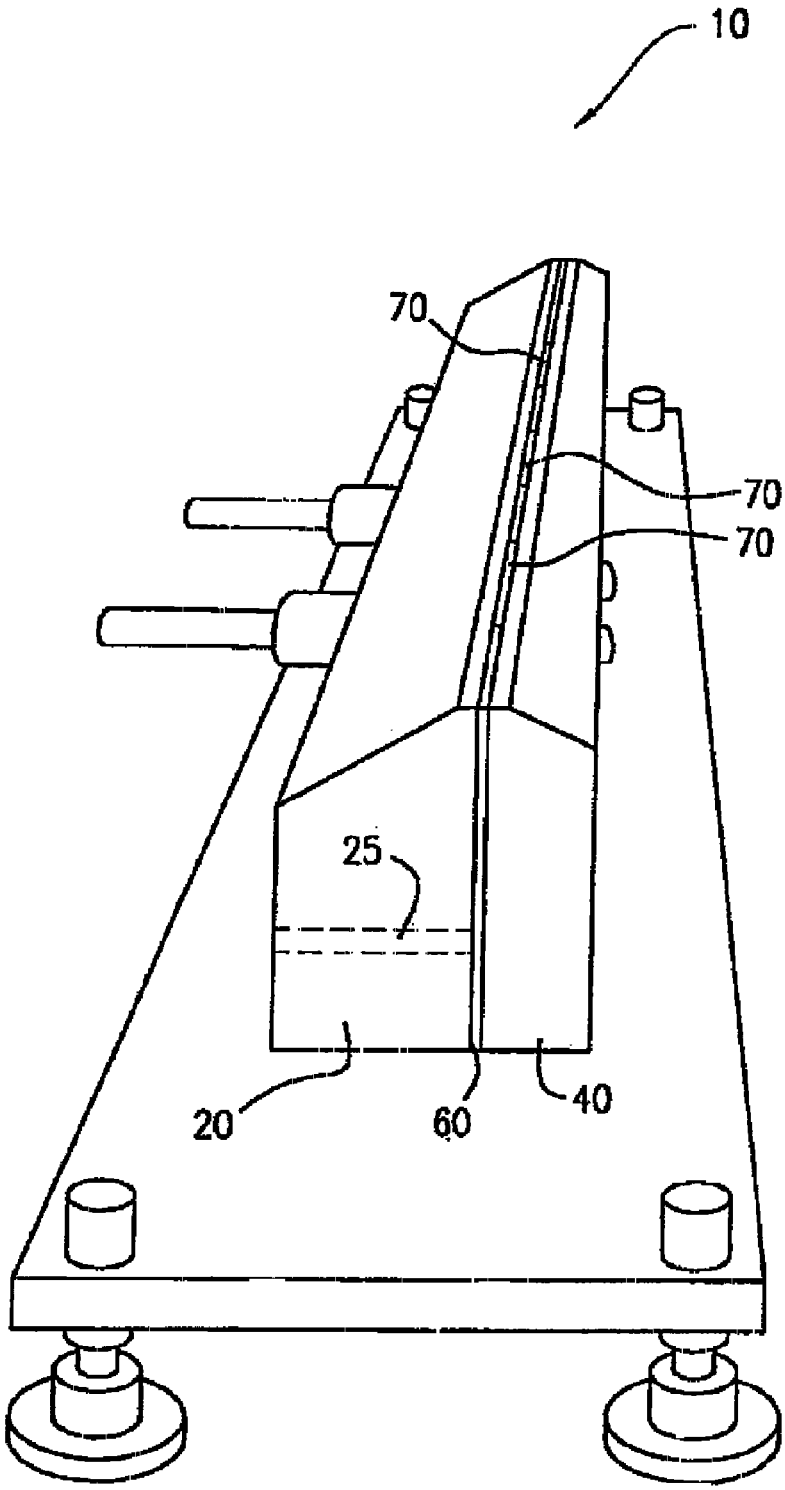
FIG. 1 is a bottom perspective view of a slot coating die used in the inventive method.

The following is a detailed description of the preferred embodiments of the invention, reference being made to the drawings in which the same reference numerals identify the same elements of structure in each of the several figures. It should be noted that these drawings are merely exemplary in nature and in no way serve to limit the scope of the invention, which is defined by the claims appealing herein below.

Figure 2:
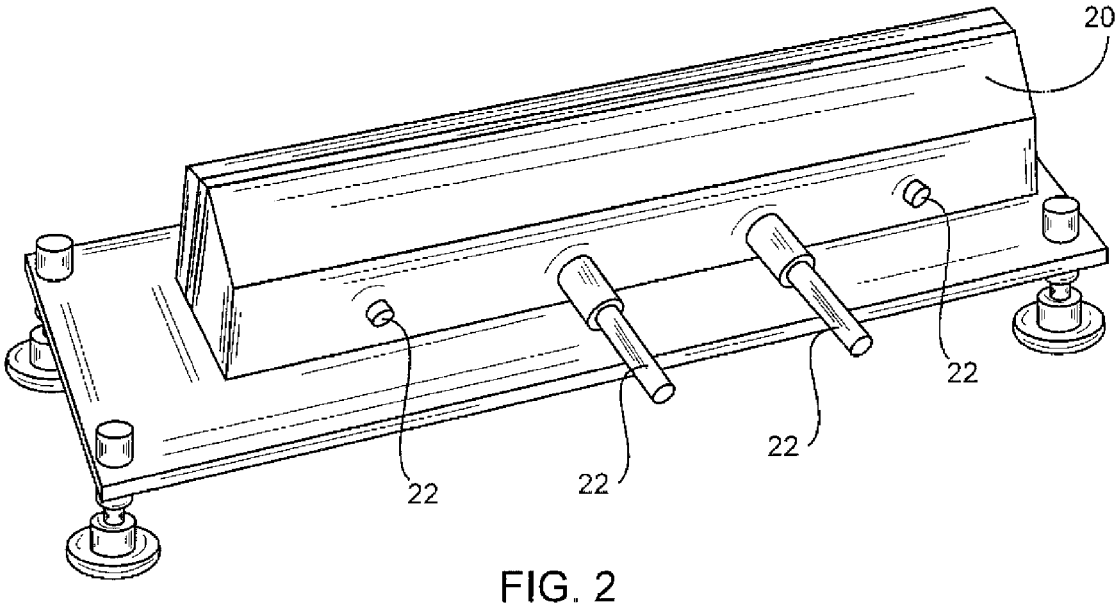
FIG. 2 front bottom perspective view of the slot coating die of FIG. 1.

The various coatings of the product are applied via a technique referred to herein as "slot curtain die coating." The die in question is shown in FIGS. 1-4 in various states of assembly as die 10. As best shown in FIG. 1, die 10 includes front die section 20, rear die section 40, and a specially shaped shim 60 disposed therebetween. All three parts are tightly secured together, preferably by bolting, e.g., by bolts 24 (see FIG. 6). Referring to FIG. 2, front die section 20 includes inlets 22 which feed internal bores 25 with liquid nail enamel or any of the other components of the product.

Figure 3:
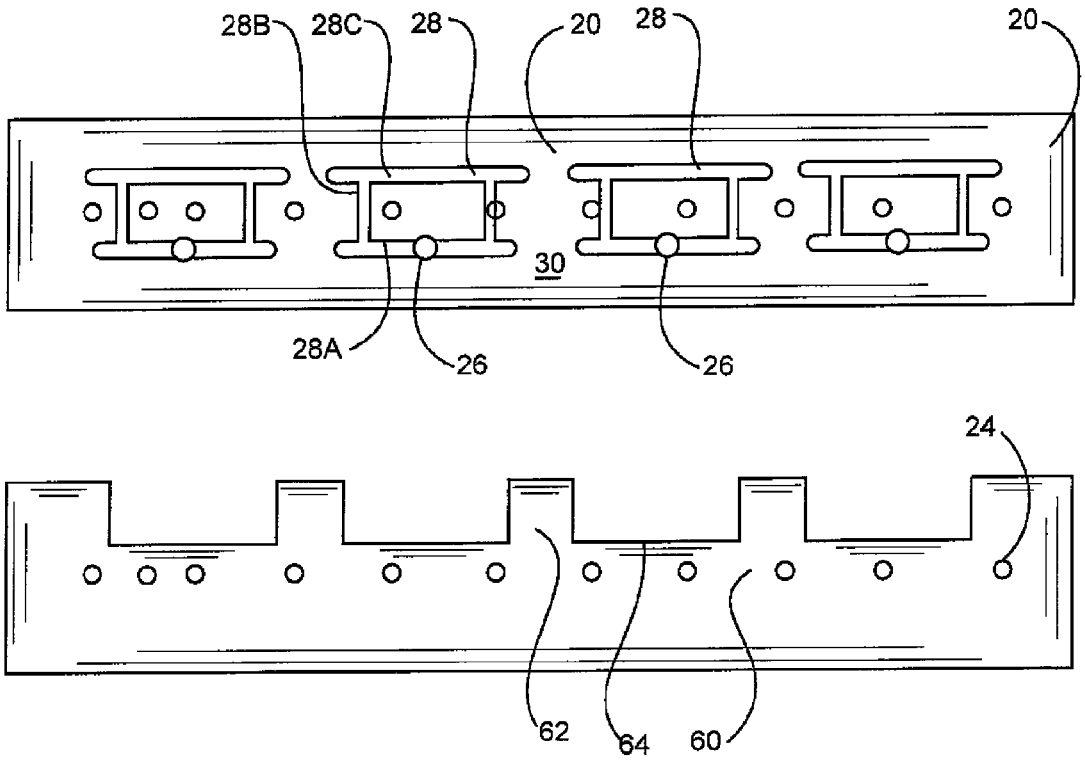
FIG. 3 is an elevational view of a shim and half of the slot coating die of FIG. 1 dissembled.
Figure 4:
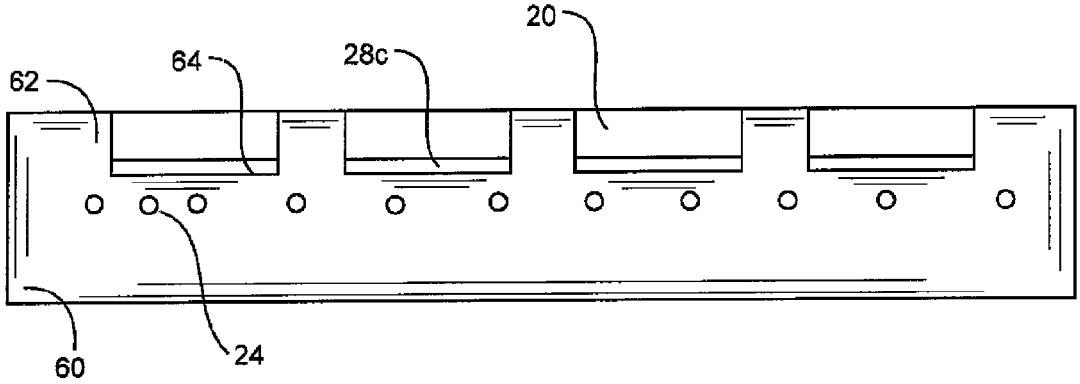
FIG. 4 is an elevation view of the shim and die half of FIG. 3 assembled.

FIGS. 3 and 4 illustrate the interior of die 10; in both of these figures, rear die section 40 has been removed for clarity. Internal bores 25 of front die section 20 terminate in outlet holes 26 on inner face 30 and reside in flow channels 28 thereon. The purpose of flow channels 28 is to direct the liquid nail enamel from outlet holes 26 in a manner that results in consistent and even application of the enamel on the substrate. As such, each flow channel 28 includes upper substantially horizontal branch 28A, which feeds into substantially vertical branches 28B and thence into lower substantially horizontal branch 28C. It should be noted that die 10 is shown in FIGS. 1-4 upside down; hence, fluid exiting outlet hole 26 seeps along horizontal branch 28A, down vertical branches 28B, and then seeps into horizontal branch 28C. The liquid enamel seeps from branch 28C and onto the substrate.

Without shim 60, the two inner faces of front and rear die sections 20 and 40 would be firmly abutting and would not allow room for the enamel to seep out of horizontal branch 28C. However, as shown in FIGS. 3 and 4, shim 60 includes vertical projections 62 between cutouts 64. When shim 60 is attached to front die section 20 by bolts 24 (see FIG. 4), it shields and covers all of flow channel 28 except fox the majority of lower horizontal branch 28C. This way, enamel flowing in branches 28A or 28B cannot seep out of these branches but must instead move forward (downward) ultimately to branch 28C. Because branch 28C is uncovered, enamel simply spills out of it and thus out of slots 70 (see FIG. 1) and onto the substrate in a sheet-like or curtain-like configuration.

Figure 5:
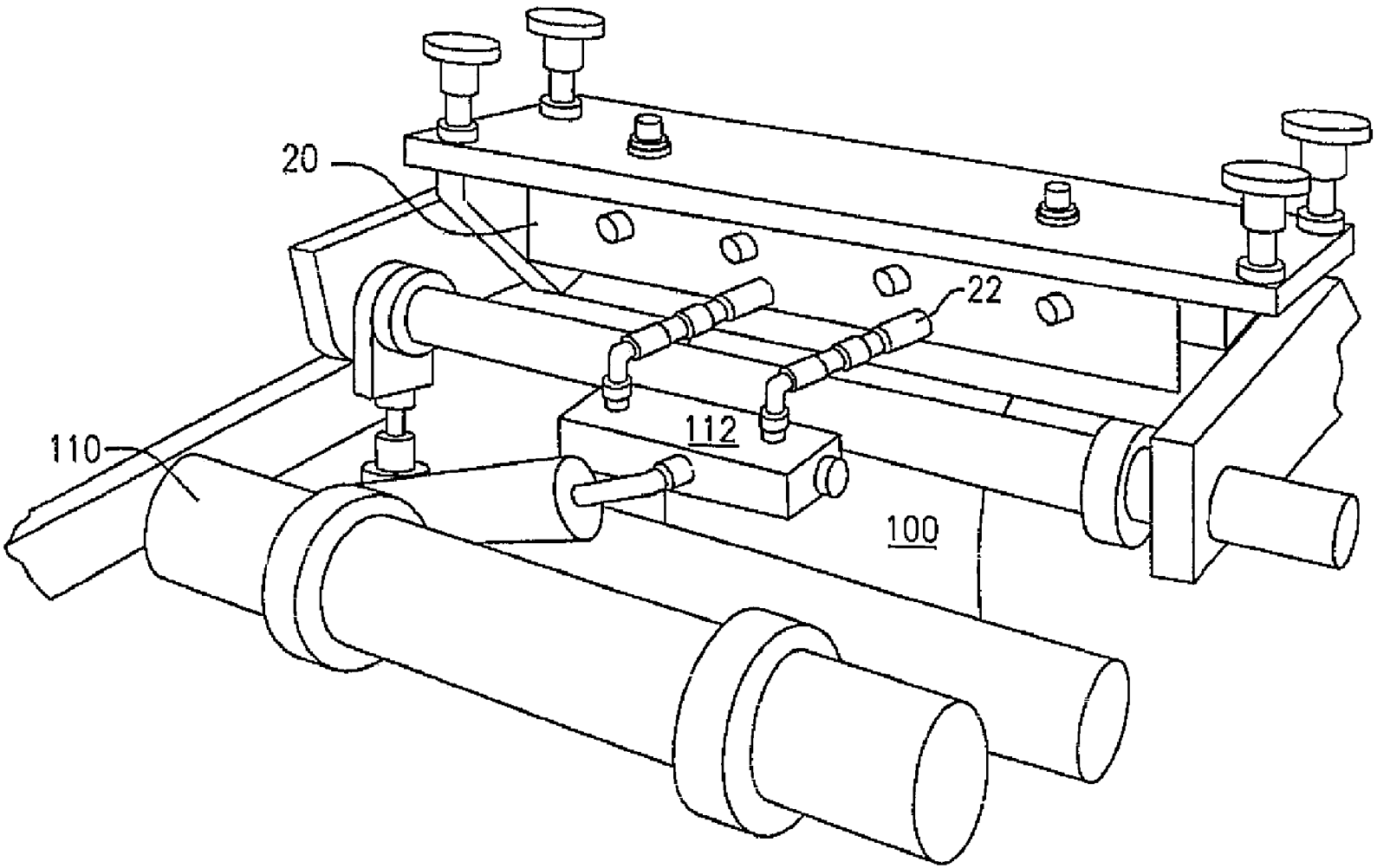
FIG. 5 is a front perspective view of a coating apparatus used in the inventive method.
Figure 6:
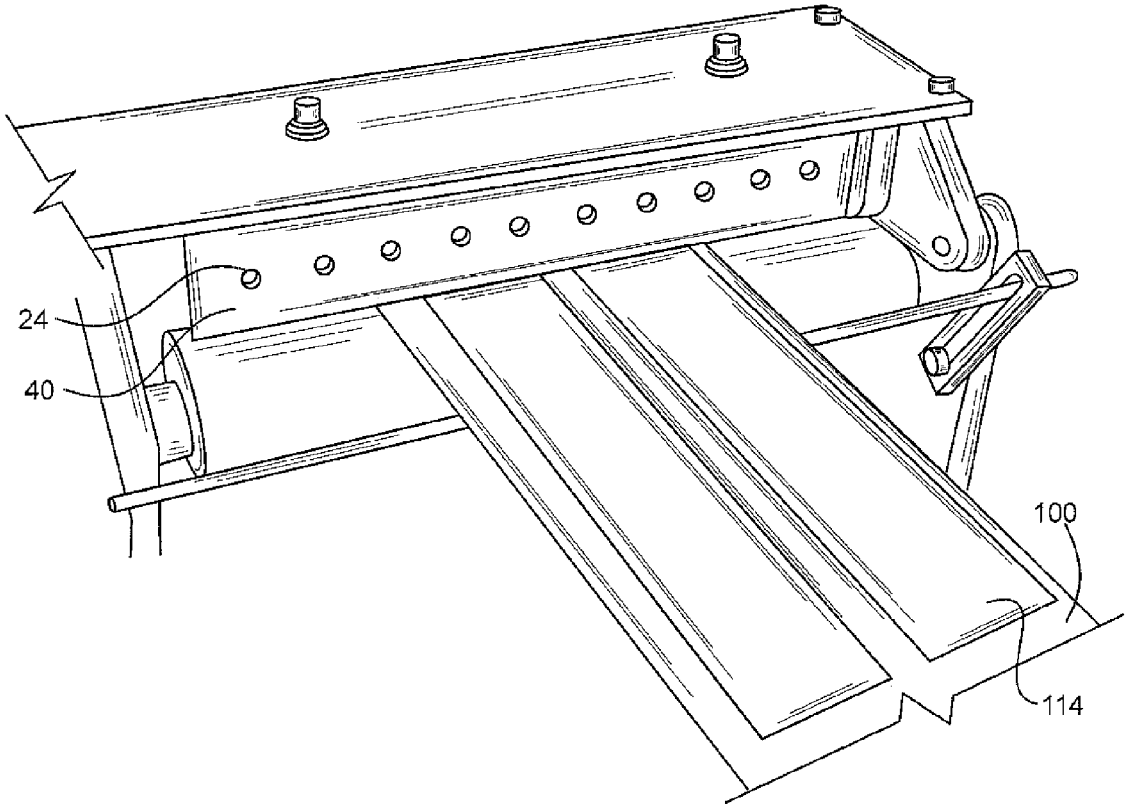
FIG. 6 is a rear perspective view of the coating apparatus of FIG. 5.

More specifically, as best illustrated in FIGS. 5 and 6, substrate 100 is fed into the machinery by rollers 110. Liquid enamel source 112 is attached to inlets 22 so that heated, pressurized liquid enamel can be forced into die 10. When substrate 100 passes under die 10, liquid enamel or other components being coated, fall out of slots 70 and onto substrate 100 thereby forming layer 102.

Figure 7:
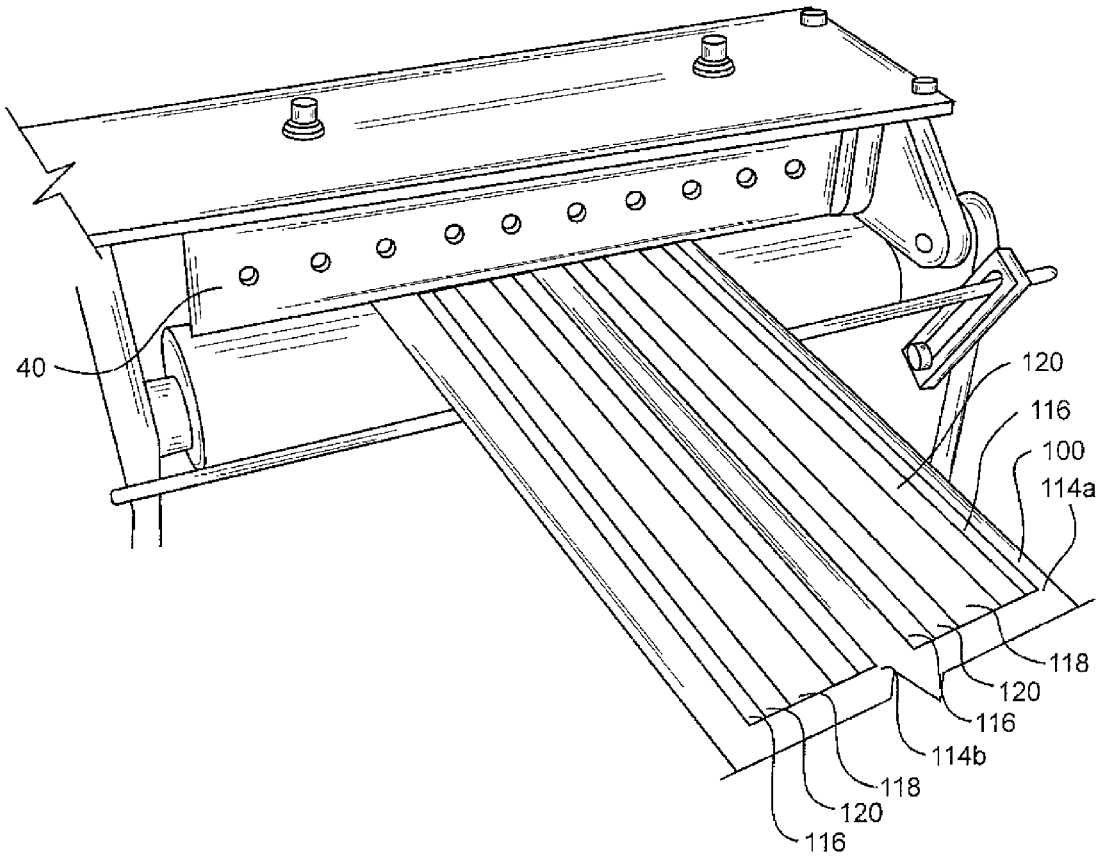
FIG. 7 is a rear perspective view of the coating apparatus of FIG. 5 being used to create a nail appliqué product in according to an embodiment of the invention.

In one preferred embodiment, nail portions and nail tip portions ate produced in the manner depicted in FIG. 7. As shown, three discrete strips of liquid enamel are applied to section 114*a* and 114*b*, both of which are on substrate 100. Strip 116 comprises white colored enamel, whereas strip 118 comprises pink enamel Strip 120, which lies between strips 116 and 118 contains no enamel. Strips 116 and 118 may be applied by two separate coating dies, but more preferably, a single coating die configured with separate inlets 22 for each color is utilized. For the purposes of a French-style tip, the nail portion (corresponding to strip 118) is preferably a shade of pink and the nail tip portion (corresponding to strip 116) is prefer ably a shade of white, however, substantially any two colors may be used.

Figure 8:
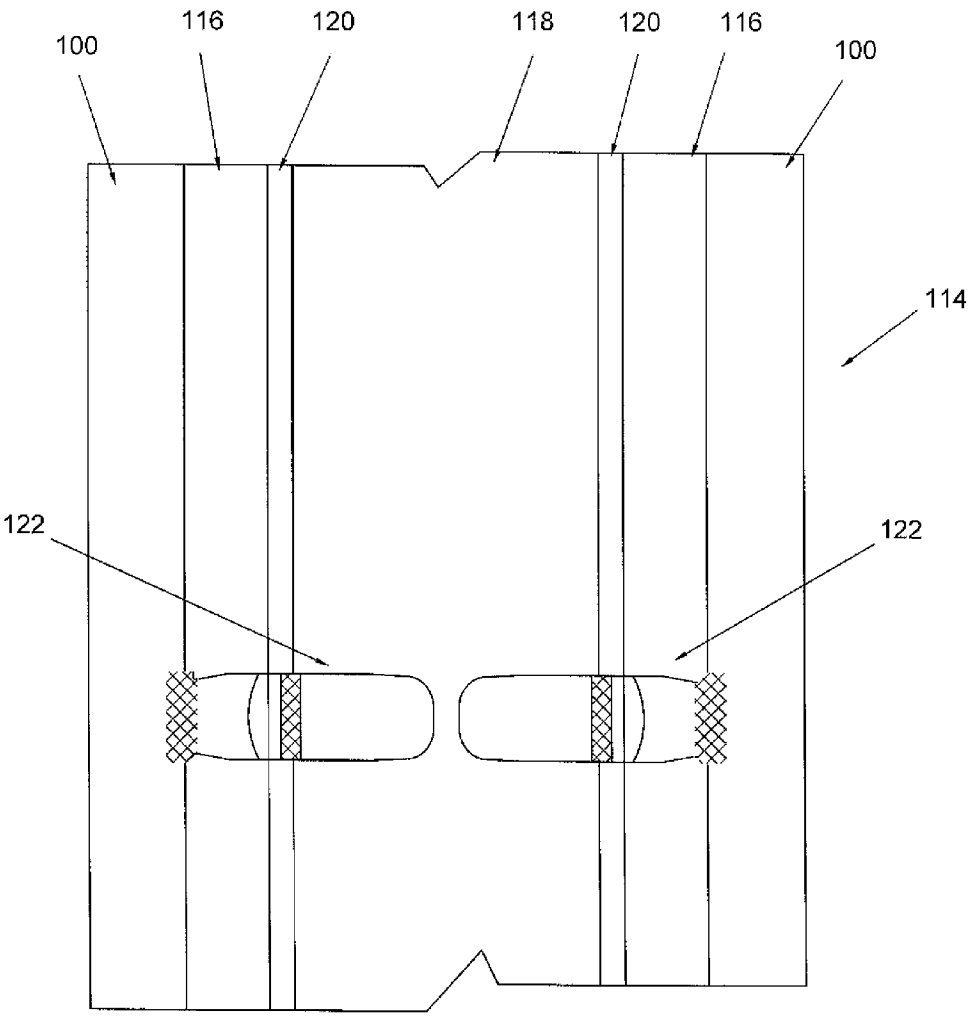
FIG. 8 is a schematic showing the representative cutting of a nail appliqué in accordance with an embodiment of the invention.
Figure 9:
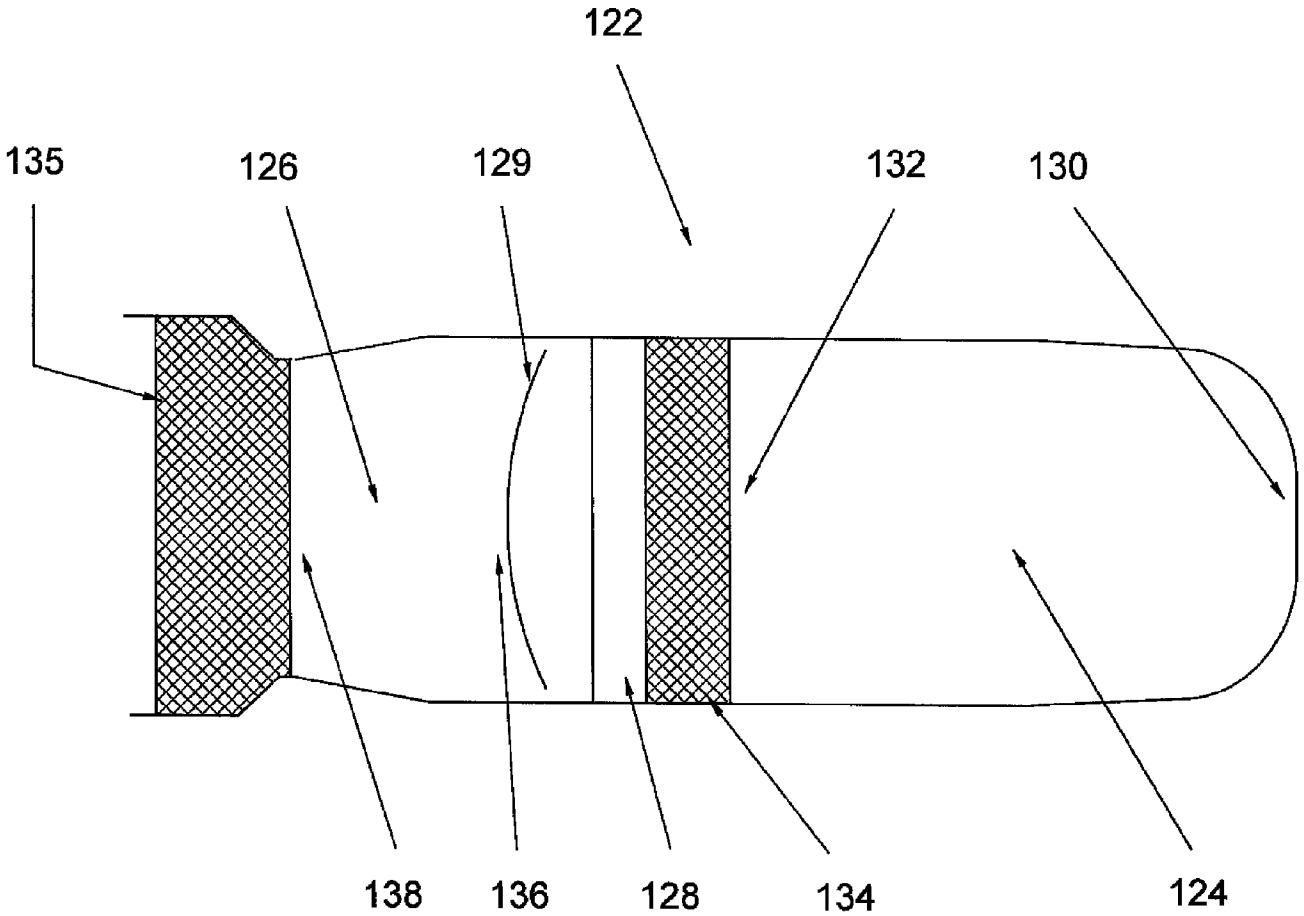
FIG. 9 shows a single nail appliqué according to an embodiment of the invention.

In FIGS. 8 and 9 a narrow, oblong appliqué 122 is cut out of section 114. The cut extends at least through portion of strip 116, 118 and 120. As such, a single appliqué 122 has a first section 124 of one color (e.g., pink) and a second section 126 of a second color (e.g., white) with an area 128 having no enamel disposed therebetween. First section 124 comprises dry nail enamel cut out of strip 118 and second section 126 comprises dry nail enamel cut out of strip 116. Sections 124 and 126 are not contiguous, but rather are separated by an area 128 containing no enamel. The area 128 having no nail enamel corresponds to strip 120 of section 114.

The area 128 separating sections 124 and 126 is preferably at least a third of a centimeter in width. Area 128 thus serves as a focal point for a user to bend the appliqué to more easily remove it from its backing without jeopardizing the integrity of either of the enamel-containing sections.

Section 124 is adapted for coating an entire fingernail or toenail with dry nail polish and is sized and shaped to substantially conform to the size of a fingernail. Second section 126 is adapted for coating the tip portion of a finger or toenail. A partial cut (kiss cut) is made to one side 129 of section 126. The partial cut is crescent shaped and sized to substantially conform to the rounded edge of a nail tip.

Section 124 has a first end 130 and a second end 132. First end 130 is preferably curved or rounded so as to substantially conform to rounded contour of a cuticle. Extending from second end 132 is a handling tab 134 which is used to facilitate the removal of nail section 124 from its backing. Tip section 126 has a first end 136 and a second end 138. First end 136 is descent shaped or curved and a tab 135 extends from second end 138.

French manicure appliqués 122 are used as follows. First, the nail section 124 is detached from the backing 100 and applied to a user's fingernail. Preferably the nail section 124 is oriented such that first end 130 is placed at the proximal, cuticle end. The nail section 124 is smoothed out, and any portion that extends over the end of the nail is removed. Next, the nail-tip section 126 is removed from backing 100. Approaching the nail with rounded side 128 facing the same, nail tip section 126 is placed on a desired area of a nail tip. The thickness of the white strip is determined by how far onto the nail a user chooses to place the nail-tip section 126. After applying the tip-section it is smoothed out and excess portions are removed. The result is a beautiful French manicure. It should be noted that the tip section 126 may be applied first with the nail section 124 being applied atop thereto.

Figure 10:
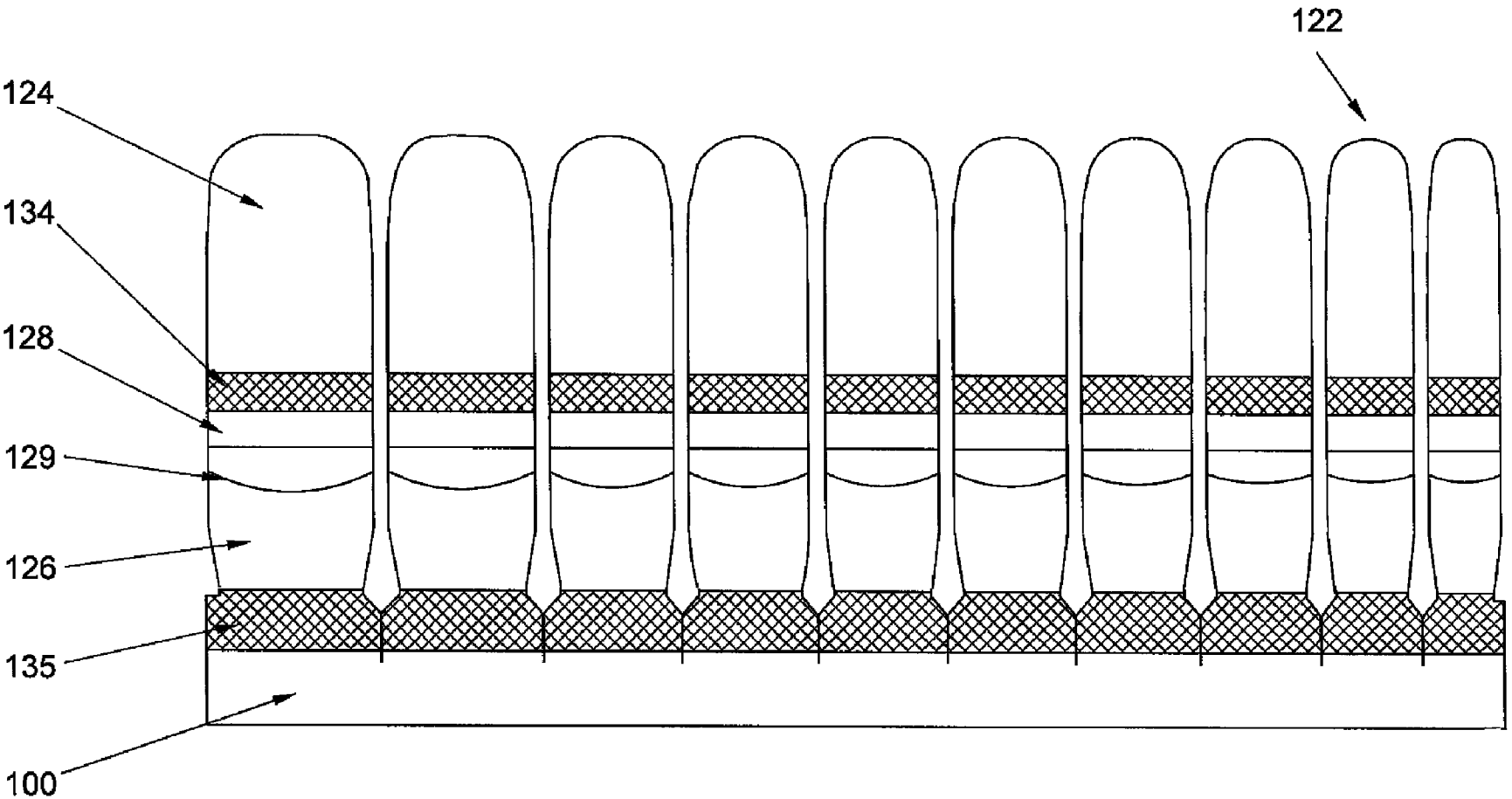
FIG. 10 shows a set of nail appliqués according to an embodiment of the invention.

FIG. 10 shows a set of inventive appliqués having been cut from a sheet similar to the one depicted in FIG. 7. The appliqués are substantially sized to conform to the size of the various fingers and share a common backing 100.

It is anticipated that the inventive nail tip appliqué can be produced using the formulations and methods of manufacture described in the patents and patent disclosures incorporated by reference herein. The term "appliqué" mentioned herein refers to the finished nail coating product comprising nail polish material and an adhesive means which is sized and shaped to substantially conform to a finger nail or to the rounded edge of a fingernail tip.

Having described this invention with regard to specific embodiments, it is to be understood that the description is not meant as a limitation since further modifications and variations may be apparent or may suggest themselves to those skilled in the art. It is intended that the present application cover all such modifications and variation as fall within the scope of the appended claims.

What is claimed is:

1. A self adhesive nail tip appliqué product for providing a French-style nail tip coating, said product comprising:

a substrate;

at least two sections of dry nail polish material disposed on said substrate, wherein a color of the nail polish material of a first one of said two sections is different from the color of a second one of said two sections;

said dry nail polish material having adhesive material on at least one surface;

said first nail polish section adapted to conform to the size and shape of a finger nail, said first nail polish section comprising a first end and a second end, said first end being curved to substantially conform to a rounded contour of a cuticle, said second end comprising a handling tab extending therefrom;

said second nail polish section comprising a first end and a second end, said first end comprising a rounded edge, said rounded edge sized to conform to the rounded edge of a nail tip, said second end comprising a handling tab extending therefrom;

whereby said handling tab extending from said second end of said first nail polish section and said handling tab extending from said second end of said second nail polish section are separated by said second nail polish section.

2. The product of claim 1 wherein said first section and said second section are removably affixed to a common backing.

3. The product of claim 1 wherein said appliqué is cut out of a section comprising a strip of dry enamel having one color, a strip of dry nail enamel having a second color.

4. The product of claim 3 wherein an area having no nail enamel separates is disposed between said strips.

5. The product of claim 1, wherein said first section is pink and said second section is white.

6. The product of claim 1, wherein a plurality of appliqués are cut out of a common sheet.

* * * * *